US007097085B2

(12) United States Patent
Arnold et al.

(10) Patent No.: US 7,097,085 B2
(45) Date of Patent: Aug. 29, 2006

(54) EXPLOSIVELY ACTUATED TOOLS

(75) Inventors: Aaron Anthony Arnold, Fullarton (AU); David John McCullough, Hawthorn East (AU)

(73) Assignee: Cetram Pty Limited, Victoria (AU)

( * ) Notice: Subject to any disclaimer, the term of this patent is extended or adjusted under 35 U.S.C. 154(b) by 0 days.

(21) Appl. No.: 10/859,115

(22) Filed: Jun. 3, 2004

(65) Prior Publication Data

US 2004/0245308 A1 Dec. 9, 2004

(30) Foreign Application Priority Data

Jun. 6, 2003 (AU) ..... 2003902859
Jul. 16, 2003 (AU) ..... 2003903681

(51) Int. Cl.
*B25C 1/08* (2006.01)
*B25C 1/10* (2006.01)

(52) U.S. Cl. ..... 227/9; 227/10; 227/11

(58) Field of Classification Search ..... 227/8, 227/9, 10, 11, 109, 201, 211, 212
See application file for complete search history.

(56) References Cited

U.S. PATENT DOCUMENTS 2,679,645 A * 6/1954 Erickson et al. ..... 227/11
2,787,000 A * 4/1957 Smith et al. ..... 227/9
3,302,840 A * 2/1967 Toshishige et al. ..... 227/8
3,622,060 A * 11/1971 Gussalli ..... 227/8
4,068,790 A * 1/1978 Osterle et al. ..... 227/8
4,358,041 A * 11/1982 Ollivier ..... 227/10
4,565,312 A * 1/1986 Berry ..... 227/8
4,804,127 A * 2/1989 Kirkman ..... 227/10
5,197,646 A 3/1993 Nikolich
5,465,893 A 11/1995 Thompson
5,992,723 A 11/1999 Lee
6,015,078 A * 1/2000 Almeras et al. ..... 227/10
6,029,878 A * 2/2000 Pfister et al. ..... 227/10
6,039,229 A * 3/2000 Pfister et al. ..... 227/10
6,260,519 B1 7/2001 Phillips
6,364,190 B1 * 4/2002 Tor ..... 227/10

FOREIGN PATENT DOCUMENTS

EP 0560049 9/1993
EP 1 197 301 A2 4/2002

* cited by examiner

*Primary Examiner*—Rinaldi I. Rada
*Assistant Examiner*—Nathaniel Chukwurah
(74) *Attorney, Agent, or Firm*—Lowe Hauptman & Berner, LLP

(57) ABSTRACT

An explosively actuated tool for driving a fastener into a substrate is of the type in which the tool is mounted to the end of a pole-like handle to permit manipulation and actuation of the tool from a remote position wherein actuation of the tool occurs by pushing the forward end of a barrel of the tool against the substrate using the handle and then pushing on the handle which loads and then releases the firing mechanism of the tool. A lock device is incorporated to prevent "air firing" of the tool by pushing the handle without the forward end of the barrel being pressed against the substrate. The lock device has a lock member which cooperates with the firing pin or firing pin spring support of the firing mechanism to lock one or other of those components unless the lock member is released by a prior displacement caused by retraction of the barrel when its forward end is pressed against the substrate.

17 Claims, 11 Drawing Sheets

EXPLOSIVELY ACTUATED TOOLS

BACKGROUND OF THE INVENTION

1. Field of the Invention

The present invention relates to an explosively actuated tool for driving a fastener, such as a pin, into a substrate, for example of concrete or steel.

2. Description of the Prior Art

Explosively actuated tools for driving a fastener, such as a pin, into a hard substrate, such as of concrete or steel, are in common use and operate by detonation of an explosive charge. In most prior tools of this type, detonation of the charge drives a piston within a barrel of the tool and the piston, in turn, drives the fastener which is positioned within the forward end of the barrel prior to firing. Tools of this general type will typically have a pistol grip and the tool is actuated by operation of a trigger associated with the grip.

A version of the tool has been developed for driving fasteners into substrates remote from the operator, for example for driving a fastener into a ceiling while the operator is still standing on the floor beneath the ceiling or for driving a fastener into a remote wall. This version of the tool is designed to be mounted at one end of a long handle or pole held by the operator. This version of the tool is termed a "pole tool". Pole tools are disclosed in U.S. Pat. No. 5,465,893 and European patent application 1 197 301 (AU 6997/01). In these previously proposed pole tools, the barrel, which contains the fastener driving piston, is slidably mounted within the housing of the tool. The barrel is biased to a forwards position and when the forward end of the barrel is pressed against the substrate the barrel is caused to retract into the housing so that a charge chamber formed at the rear end of the barrel moves over and encloses the explosive charge. This occurs by the operator manipulating the pole so as to press the forward end of the barrel against the substrate. The pole itself is mounted to a firing pin mechanism of the tool and further pressing movement applied to the tool via the pole loads the firing pin mechanism which, when a predetermined loading is reached, releases the firing pin to detonate the charge.

With these previously proposed pole tools it is possible to fire the tool by holding the housing of the tool with one hand and pressing the pole inwardly with the other hand in order to load and then release the firing mechanism, so-called "air firing" of the tool. Although the consequences of this are unlikely to be particularly serious as, if the tool is operated in this mode, the barrel will not have been displaced rearwardly so that its charge chamber encloses the charge and as a result the power output of the tool will be greatly diminished, nevertheless the fact that the tool is able to be fired in this mode does give rise to concern.

SUMMARY OF THE INVENTION

According to the present invention there is provided an explosively actuated tool for driving a fastener into a substrate, said tool having a barrel from which the fastener is fired, the barrel being mounted within a housing to project from the forward end of the housing and the barrel being displaceable rearwardly relative to the housing when the forward end of the barrel is pressed against the substrate, a firing mechanism actuable by forwards displacement of a pole-like handle attachable to the rear end of the tool to permit manipulation and actuation of the tool from a remote position, and a lock device for preventing actuation of the firing mechanism to fire an explosive charge absent displacement of the barrel into a predetermined rearwards position within the housing consequent on pressing the forward end of the barrel against the substrate.

In the preferred embodiment of the invention, the firing mechanism includes a firing pin and a firing pin spring which is loaded by forwards movement of structure displaced by moving the handle forwardly relative to the housing.

In one form, the lock device has a lock member which prevents forwards movement of said structure sufficient to effect firing, the lock member being released in response to displacement of the barrel rearwardly into said predetermined rearwards position.

Advantageously the predetermined rearwards position of the barrel in which release of the lock member is effected is a rearmost position in which a charge chamber at the rear end of the barrel encloses the explosive charge. The lock member is normally held in its locking position and is displaced into its released position in response to movement of the barrel into its rearmost position.

In one practical form of the embodiment this displacement is achieved by engagement of the lock member with a rear end part of the barrel as the barrel moves into its rearmost position.

Preferably the lock member is a lock lever pivotal between its locking and released positions and spring biased into its locking position. Advantageously the locking lever is displaced to its released position by a camming action when the rear end part of the barrel engages a forward end of the lever as the barrel moves into its rearmost position. The camming action can be provided by a cam surface on the lever co-operating with a cam surface within the tool housing.

In another form, the lock device has a lock member operative to lock the firing pin against release in the event of forwards movement of said structure absent displacement of the barrel into said predetermined rearwards position, the locking effect of the lock member being disabled in response to displacement of the barrel into said predetermined rearwards position.

Advantageously, the predetermined rearwards position of the barrel in which action of the lock member is disabled is a rearmost position in which a charge chamber at the rear end of the barrel encloses the explosive charge. The lock member is normally held in a position in which a locking part thereof is in alignment with, or within, a locking recess in the firing pin and is displaced into its disabled position in response to movement of the barrel into its rearmost position.

In one practical form this displacement is achieved by engagement of the lock member with a rear end part of the barrel as the barrel moves into its rearmost position.

Preferably the lock member is a lock lever pivotal between its locking and disabled positions and spring biased into its locking position. In one practical form, co-operation between the said structure and the lock lever enables displacement of the locking lever into its locking position absent the required movement of the barrel into its rearmost position. Preferably, the lock lever co-operates directly with a firing pin support forming part of said structure, a part of the firing pin support normally closing the locking recess in the firing pin and then exposing the recess to permit engagement by the lock lever when the firing pin support displaces forwardly absent the required barrel movement.

Further according to the present invention, there is provided an explosively actuated tool for driving a fastener into a substrate, the tool being of the type in which the tool is mounted to the end of a pole-like handle to permit manipulation and actuation of the tool from a remote position wherein actuation of the tool occurs by pushing the forward end of a barrel of the tool against the substrate using the handle and then pushing on the handle which loads and then releases a firing mechanism of the tool, the firing mechanism including a firing pin, a firing pin spring, and a firing pin spring support by which the firing pin spring is loaded, wherein the tool has a lock device to prevent air firing of the tool by pushing the handle without the forward end of the barrel being pressed against the substrate, the lock device including a lock member which cooperates with the firing pin or firing pin spring support to lock one or other of those components unless the lock member is released by a prior displacement caused by retraction of the barrel when its forward end is pressed against the substrate.

BRIEF DESCRIPTION OF THE DRAWINGS

An embodiment of the invention will now be described by way of example only with reference to the accompanying drawings in which.

DESCRIPTION OF THE PREFERRED EMBODIMENTS

Figure 1:
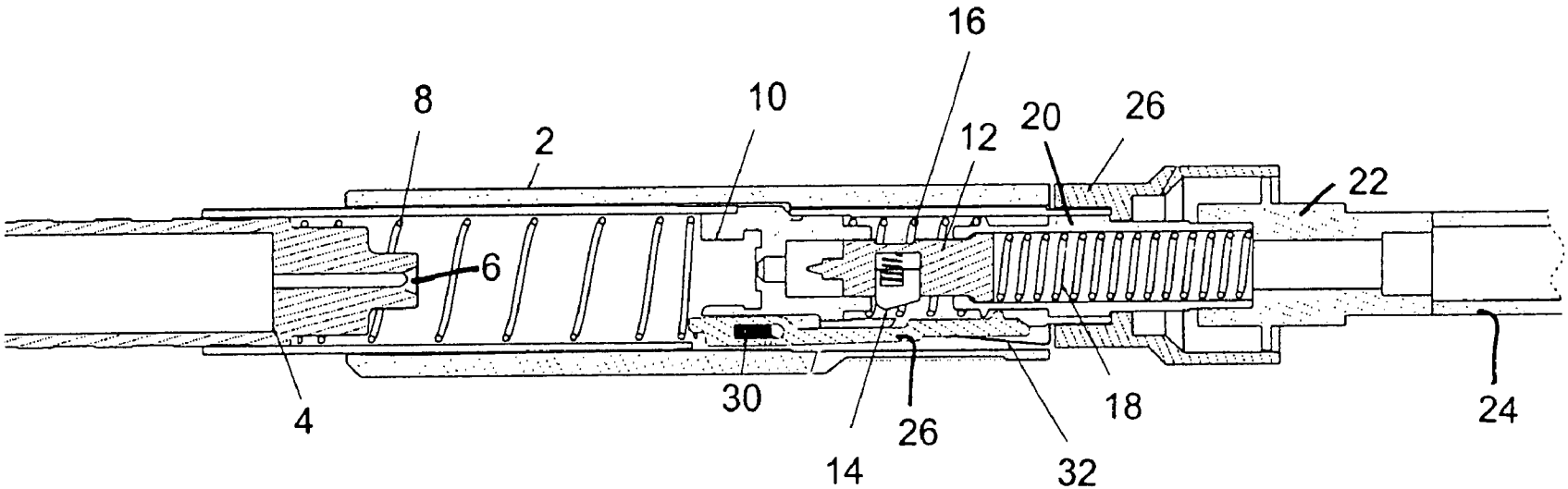
FIG. 1 shows diagrammatically part of a pole tool in accordance with one embodiment of the invention, in an at rest condition prior to firing.

A pole in accordance with the preferred embodiment of the invention is of the type disclosed in U.S. Pat. No. 5,465,893 and EP 1 197 301 discussed above and only those parts of the tool which relate to the improvement provided by the present invention will be described in detail. FIG. 1 shows schematically the tool housing 2 and the barrel 4 slidably mounted within the forward end of the housing 2. The barrel contains a fastener driving piston (not shown) and the charge chamber at the rear end of the barrel 4 is shown at 6. A compression spring 8 is mounted within the housing 2 to bias the barrel 4 into a forwards position. A receiver body 10 for receiving an explosive charge carried by a charge strip in the manner illustrated in the aforesaid patent specifications is mounted in the housing 2 rearwardly of the rear end of the barrel 4 when in its forward position. The receiver body 10 mounts a firing pin 12 which is held in a retracted READY position (as shown in FIG. 1) by a retractable spring loaded pawl 14 mounted within the firing pin 12 and releasably engageable with the rear end of the receiver body 10. The firing pin 12 is associated with a return spring 16 which operates to return the firing pin 12 to the READY position after firing. A firing pin spring 18 is housed within a tubular support 20 which is mounted within the tool housing 2 for sliding movement over the firing pin 12. At its rear end the support 20 carries an outer coupling 22 to which the pole-like handle 24 can be releasably attached. The coupling 22 is itself guided for sliding movement within a retaining collar 26 at the rear end of the housing 2, and the collar 26 also provides sliding support for the firing pin spring support 20.

Figure 2:
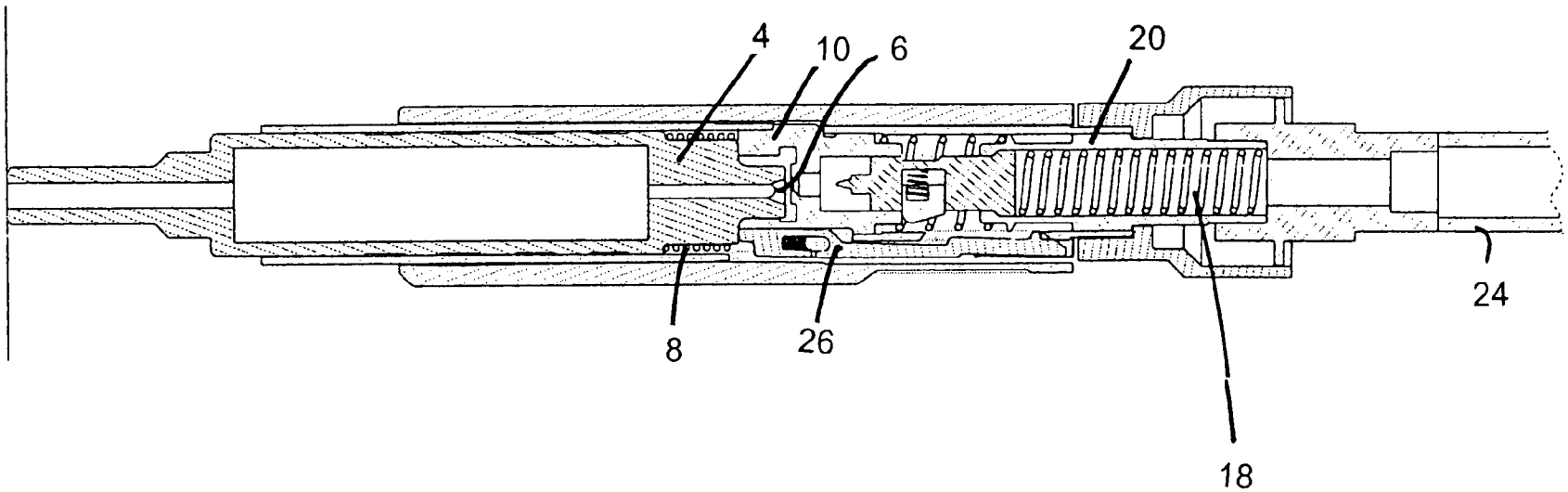
FIG. 2 shows the tool when the barrel has been displaced into a rearmost position by pressing the forward end of the barrel against a substrate.
Figure 3:
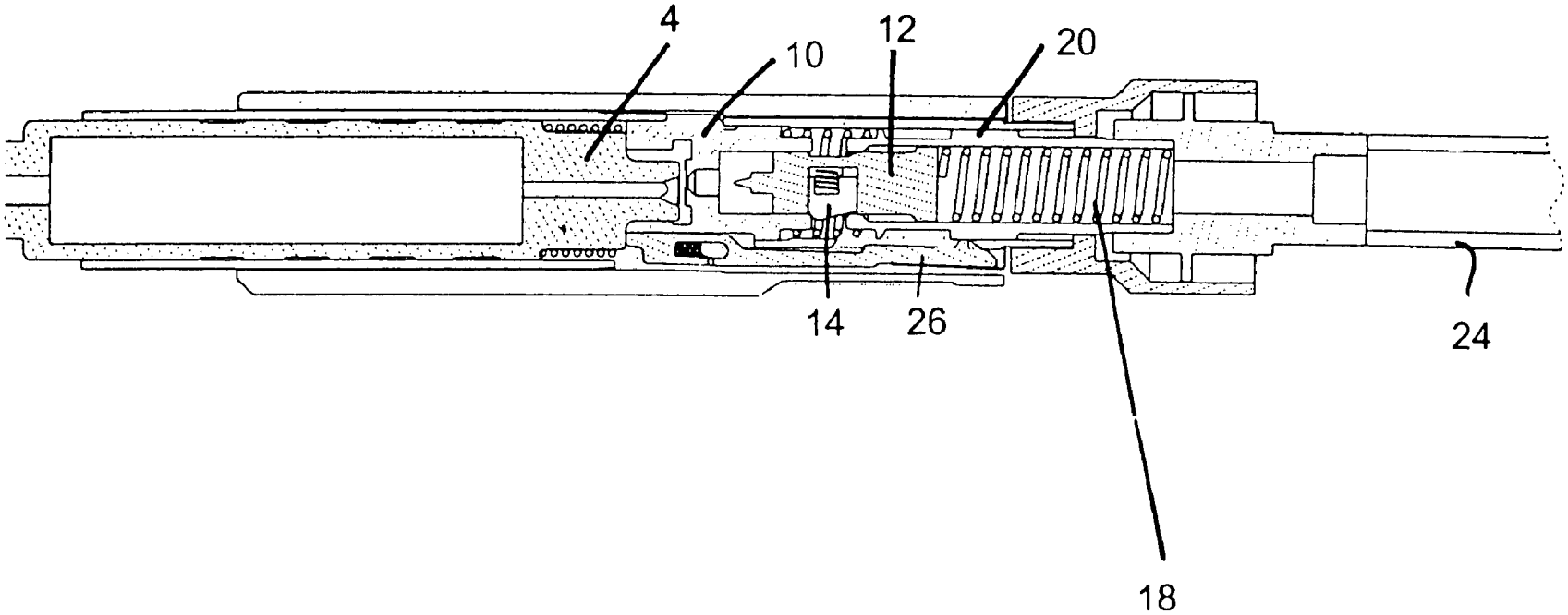
FIG. 3 shows the tool during loading of the firing pin mechanism shortly before firing.
Figure 4:
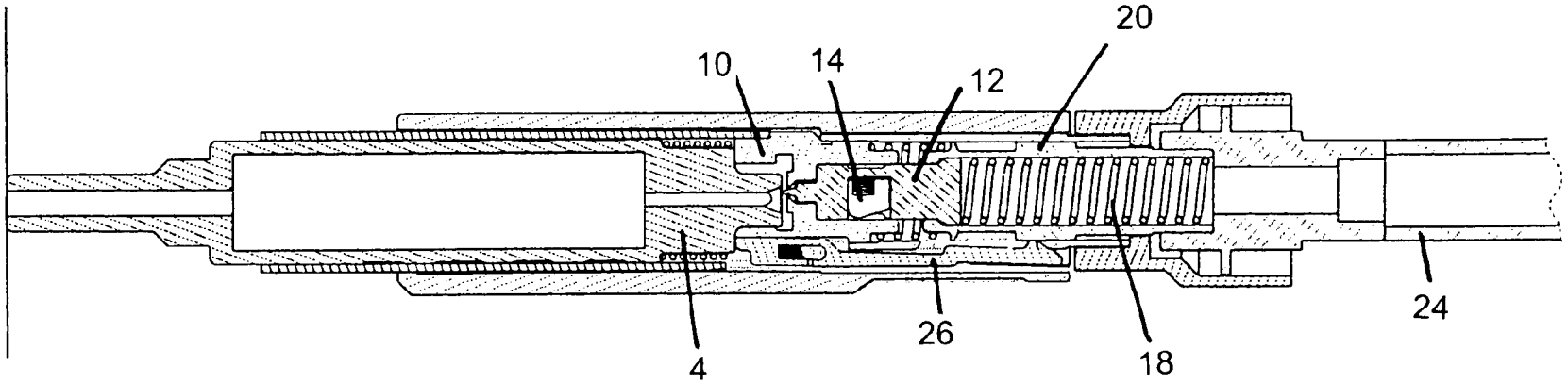
FIG. 4 shows the condition of the tool when firing has occurred.

In operation, when the forward end of the barrel 4 is placed against the substrate by manipulating the pole 24, and axial force is applied via the pole 24, the barrel 4 is displaced inwardly from the position shown in FIG. 1 to the position shown in FIG. 2 in which its charge chamber 6 moves over and encloses the explosive charge held in the operative position in the receiver body 10. This is the position as shown in FIG. 2, although for clarity of illustration the charge itself is not actually shown in that figure. At this point further axial force applied by the pole 24 displaces the firing pin spring support 20 forwardly along the firing pin 12 thereby loading the firing pin spring 18 (see FIG. 3), the firing pin 12 being held in its retracted READY position by the spring loaded pawl 14. When the loading in the firing pin spring 18 becomes sufficient to overcome the force of the spring which biases the pawl 14 outwardly to its engaged position with the receiver body, the pawl 14 is caused to retract thereby releasing the firing pin 12 for rapid movement forwardly within the receiver body in order to detonate the explosive charge as shown in FIG. 4. After the tool has been fired and released from the substrate, the barrel 4 is returned forwardly to its original position by the barrel return spring 8, and the firing pin support 20 is moved rearwardly to its original position by the firing pin return spring 16. The firing pin 12 itself is entrained by the support 20 during this movement and is thereby returned to its retracted READY position with the spring loaded pawl 14 projecting outwardly into engagement with the rear edge of the receiver body 10.

In accordance with the invention, the tool has a lock mechanism which prevents the forwards movement of the firing pin spring support 20 and thereby the loading of the firing pin spring 18 if the barrel 4 has not been displaced into its rear position (the position shown in FIG. 2) by pressing the forward end of the barrel 4 against the substrate. Thus the tool cannot be "air fired" merely by applying a forwards force to the pole 24 while the body 2 of the tool is held.

Figure 1A:
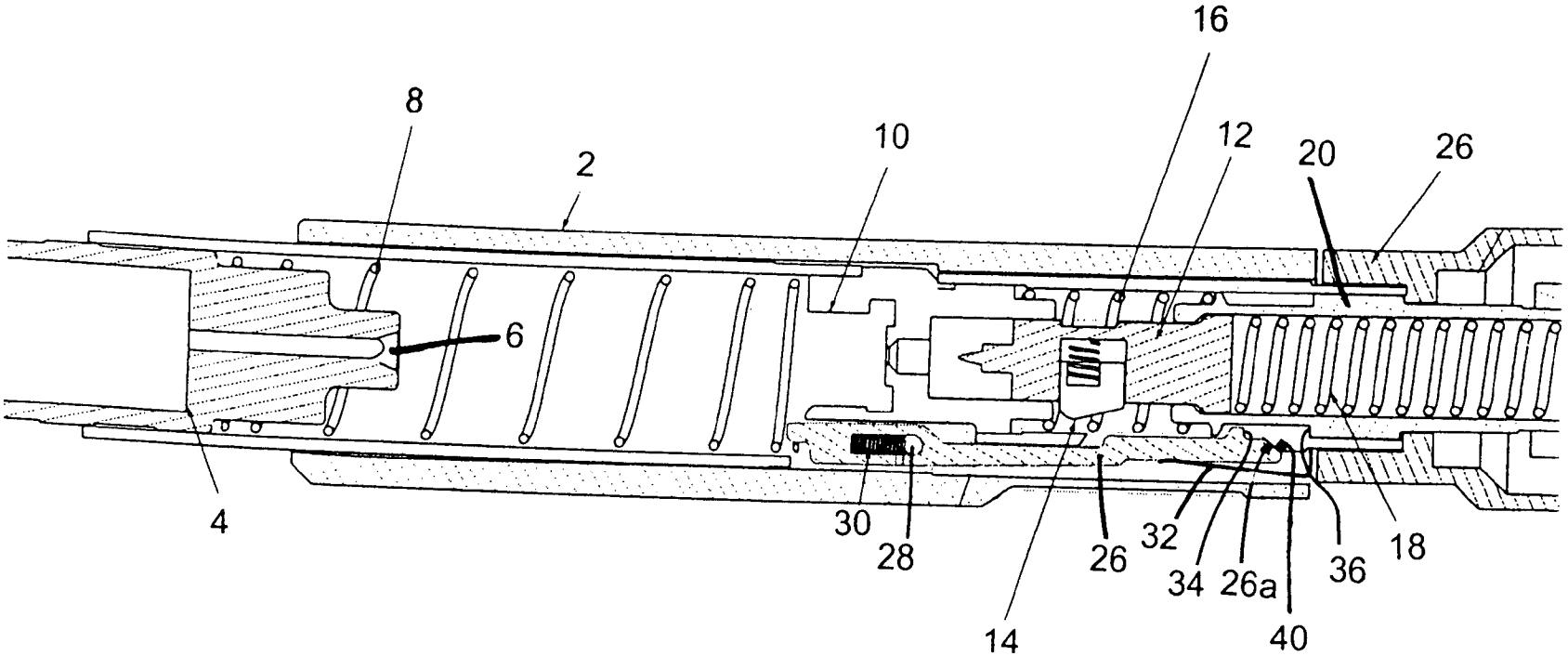
FIG. 1A shows an enlarged detail of FIG. 1.
Figure 3A:
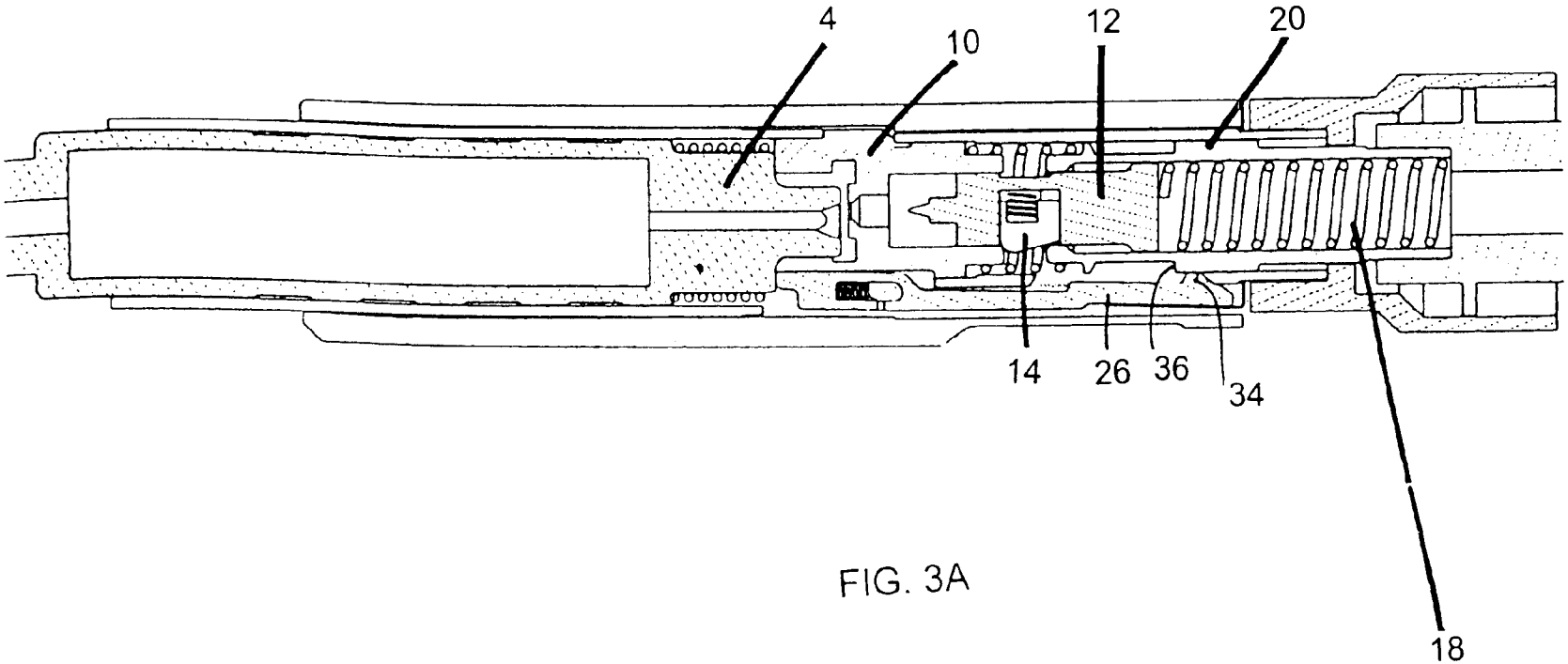
FIG. 3A is an enlarged detail of FIG. 3.
Figure 5:
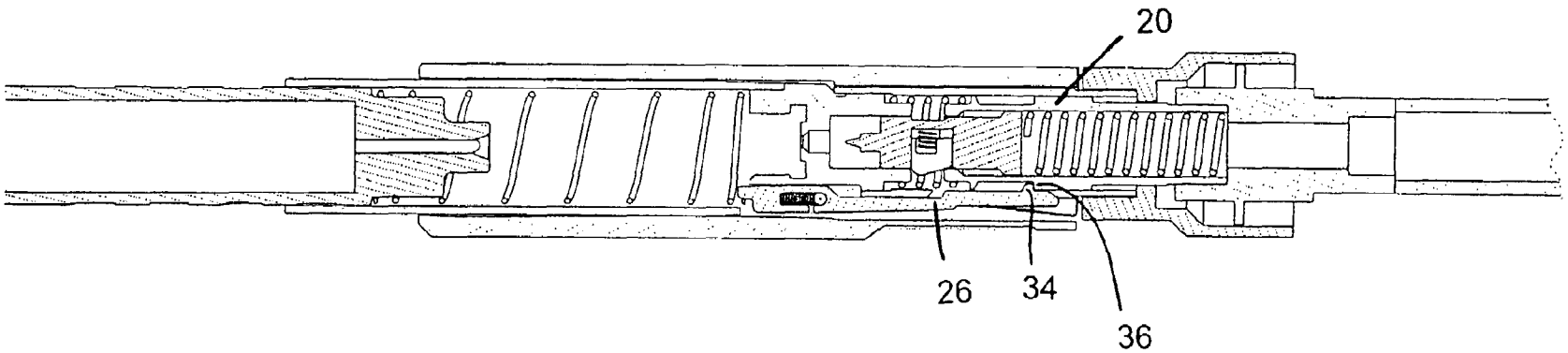
FIG. 5 shows operation of a lock mechanism if the firing mechanism is attempted to be loaded to fire the tool without the barrel being pressed against the substrate.

The lock mechanism is provided by a lock lever 26 mounted to the receiver body 10 for pivotal movement and also for axial movement. For this purpose a pivot pin 28 (see FIG. 1A) carried by the receiver body 10 is located within an axial slot in a forward end of the lock lever 26. A compression spring 30 mounted within the slot bears against the pivot pin 28 to apply an axial bias to the lock lever 26 to displace the lever into a forwards position in which its forwards end lies in the path of movement of the rear end of the barrel 4 as it approaches its rear limit position shown in FIG. 2 when the forward end of the barrel has been pressed against the substrate. The lock lever 26 is also subject to a pivotal bias provided by a leaf spring 32 so that the rear end of the lock lever 26 is biased into a radially inner position in which a stop 34 on the lever 26 lies forwardly of a shoulder or other abutment 36 on the firing pin spring support 20. This is best seen in FIG. 1A. The rear end of the lock lever 26 is ramped at 26*a* and co-operates with a ramp surface 40 within the tool body. When the barrel 4 is displaced rearwardly into the position shown in FIG. 2 which occurs when the forward end of the barrel 4 is pressed against the substrate (this represents the correct and intended mode of operation), as the barrel 4 approaches its rearmost position its rear end will engage the forward end of the lock lever 26 and displace the lever 26 rearwardly against the bias of the spring 30. As a result of the co-operation between the ramped rear end 26*a* of the lever and the fixed ramp surface 40, the rear end of the lever and thereby the stop 34 will be pivoted radially outwardly against the bias of the leaf spring 32. This outwards displacement takes the stop 34 outside of the path of movement of the shoulder 36 on the firing pin spring support 20 so that the firing pin spring support 20 can be displaced forwardly and the firing pin spring 18 loaded in the manner previously described to fire the tool. This "released" position of the lock lever 26 is shown in FIGS. 2, 3, and 3A. However, if the firing pin spring support 20 is moved forwardly in an attempt to "air fire" the tool without the forward end of the barrel 4 having been pressed against the substrate to displace the barrel 4 rearwardly, the lock lever 26 will remain in a position (its locking position) in which its stop 34 will lie forwardly of the shoulder 36 on the firing pin spring support 20 and will act to limit the forwards movement of the support 20 to an extent sufficient to prevent firing of the tool. This is the condition shown in FIG. 5.

The ramped surface 26*a* at the rear end of the lock lever 26 and the co-operating fixed ramp surface 40 provide a camming effect which causes displacement of the stop 34 on the lock lever out of the path of movement of the shoulder 36 consequent on axial displacement of the lock lever 26 as the barrel moves into its rear position. It will be appreciated that other camming arrangements can be used to achieve that effect. Likewise, other forms of spring and mounting arrangement can be used for the lock lever. Although as described the lock lever acts against the firing spring support, in alternative arrangements it can act against other components displaced by pressing the handle to fire the tool, for example coupling 22 and in that case the lever may be replaced by a suitable linkage.

After firing of the tool and release of the forward end of the barrel 4 from the substrate whereby the barrel 4 is returned to its forward position and the firing pin spring support 20 is returned to its rearward position, the spring 30 will return the lock lever 26 to its forward position in which its stop 34 lies forwardly of and in the path of movement of the shoulder 30 on the firing pin support 20 as shown in FIG. 1A.

In the event that the tool is accidentally dropped from a substantial height and the end of the pole impacts upon the ground, the lock mechanism will take the full impact load. Although the lock mechanism described above can be designed with sufficient robustness to withstand such an impact load to comply with relevant standards (Australian Standard AS1873 requires that an explosively actuated tool will not be subject to charge indentation by the firing pin if dropped from a height of 3 meters), nevertheless due to restrictions in the space available within the interior of the tool, there are limits as to the extent to which the durability of the components can be improved by increasing their size.

In the embodiment shown in FIGS. 6 to 10, the lock lever 26 locks onto the firing pin 12 rather than the firing pin spring support 20. Accordingly, the lock lever 26 will not be directly subject to an impact load imparted from the pole end of the tool if the tool is dropped. Rather, the impact load will be absorbed by the forwards displacement of the firing pin spring support 20 which is still able to be moved forwardly and will be cushioned by compression of the firing pin spring 18 and the firing pin return spring 16, but due to the lock imposed on the firing pin itself by the lock lever 26, the firing pin is held against release under the force of the firing pin spring. The lock mechanism of this embodiment will now be described in detail.

Figure 6:
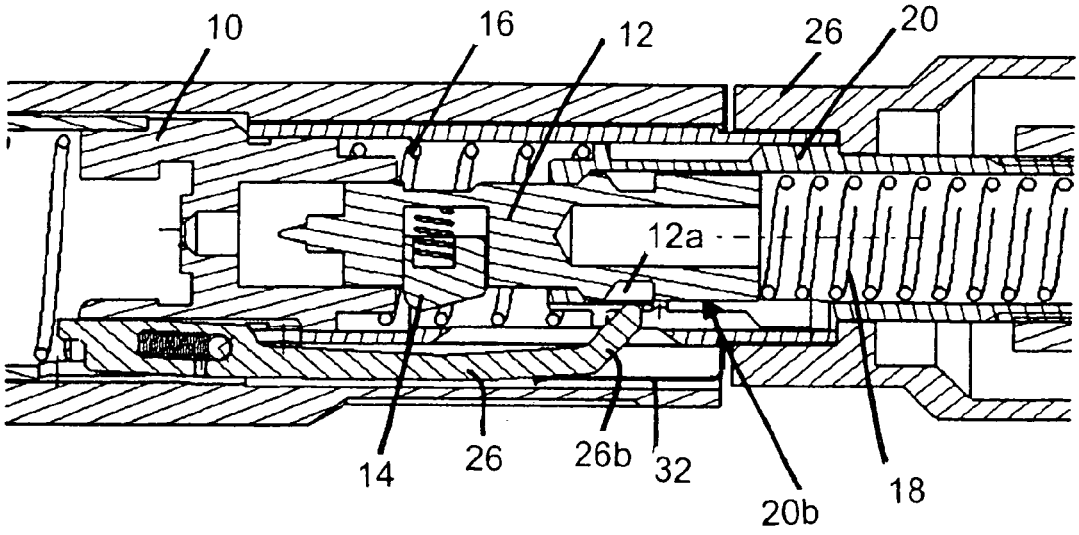
FIG. 6 shows a pole tool with an alternative embodiment of lock mechanism, the tool being shown in at rest position prior to firing.
Figure 6A:
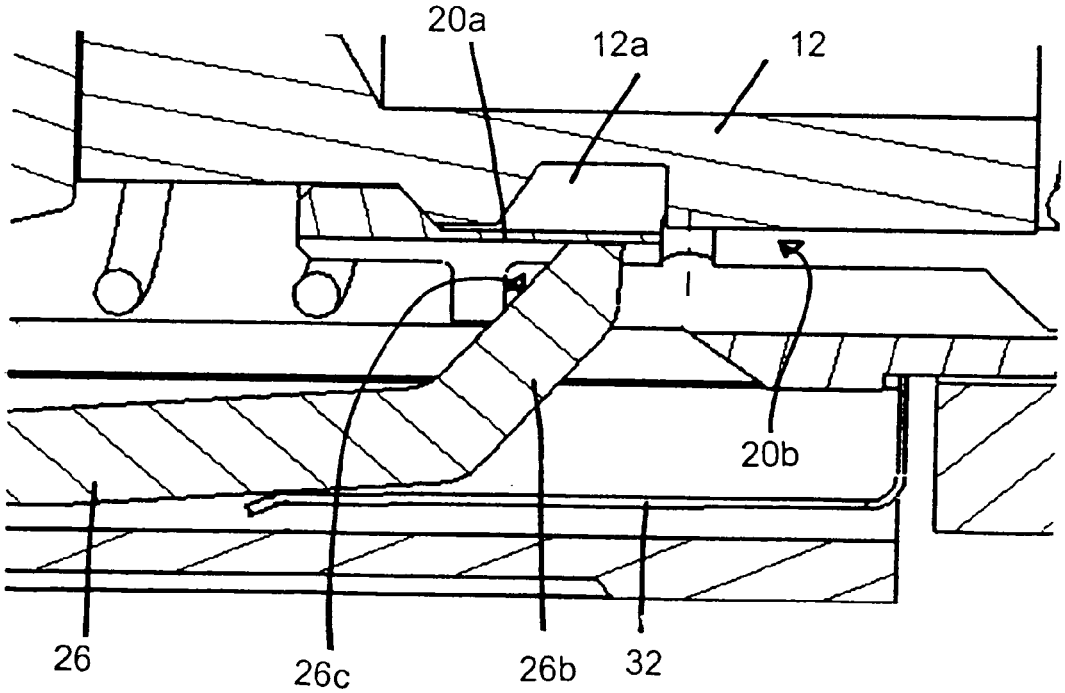
FIG. 6A shows an enlarged detail of FIG. 6.

In comparison with the previous embodiment and with initial reference to FIGS. 6 and 6A, the lock lever 26 has a locking rear end portion 26*b* which inclines inwardly towards the firing pin 12. The firing pin 12 is formed with a locking recess 12*a* which is aligned with the locking end 26*b* of the lock lever 26 when the firing pin 12 is in its retracted READY position and when the lock lever 26 itself is in its forward position which it assumes prior to its rearwards displacement when the barrel has not been displaced into its rear position by pressing its forward end against the substrate. However in this mode, the locking recess 12*a* in the firing pin 12 is covered by a forward part 20*a* of the firing pin spring support 20 and the locking end portion 26*b* of the lock lever is biased radially inwardly against the outer surface of that part by the leaf spring 32.

Figure 7:
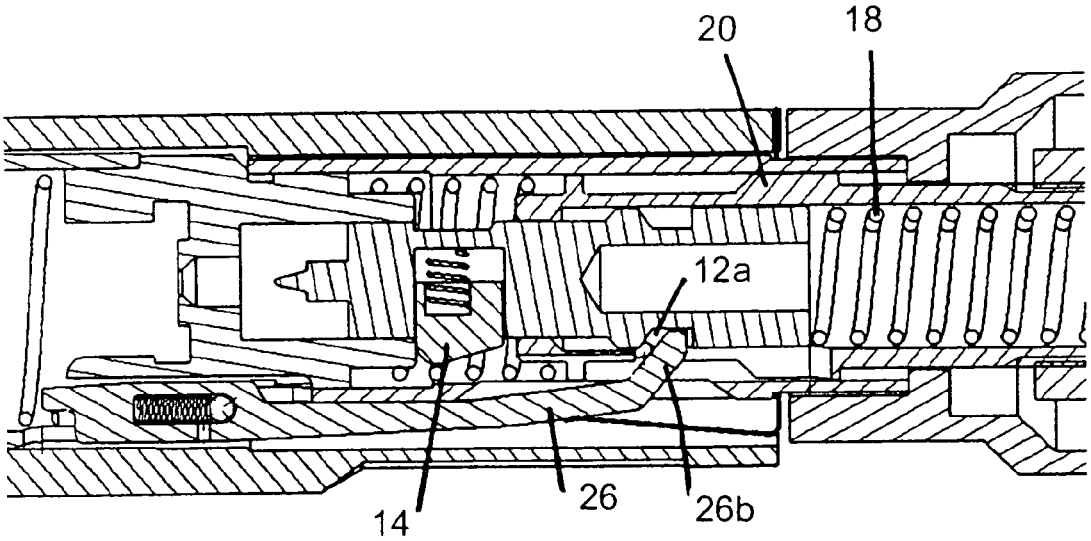
FIGS. 7 and 8 show successive stages in operation of the lock mechanism if the firing mechanism is loaded without the barrel being pressed against the substrate.
Figure 8:
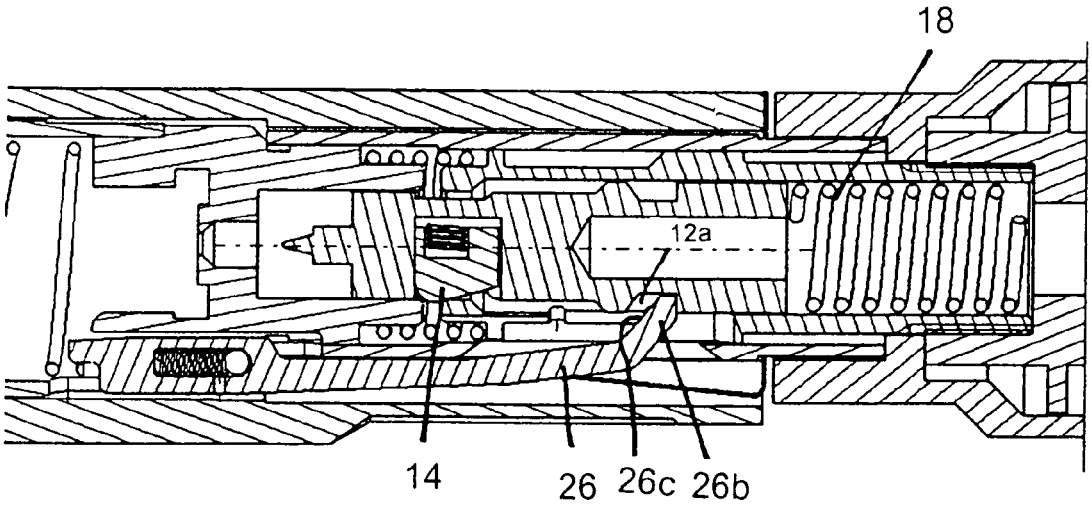

In the event that the firing pin spring support 20 is displaced forwardly without first pressing the forward end of the barrel against the substrate, as may arise either if an operator attempts to "air fire" the tool or drops the tool onto its pole end, the initial forwards displacement of the firing pin spring support 20 relative to the firing pin 12 causes the forward part 20*a* to displace forwardly away from the locking end 26*b* of the lock lever 26, and an elongate slot 20*b* in the firing pin spring support 20 immediately behind that forward portion exposes the locking recess 12*a* in the firing pin 12 whereby the locking end 26*b* of the lock lever 26 displaces inwardly under the bias of leaf spring 32 to engage into the locking recess 12*a* and thereby lock the firing pin. This is shown in FIG. 7. There is some play between the locking end 26*a* of the lock lever 26 and the locking recess 12*a* and as further force is applied to the pole some further forwards movement of the firing pin 12 will occur under the compression force of the firing pin spring 18, and the firing pin spring support 20 may displace forwardly to an extent sufficient to cause release of the firing pin pawl 14, but engagement of the locking end 26*b* in the locking recess 12*a* will define a forward stop position for the firing pin 12 and past which the firing pin 12 cannot travel to fire the charge. This is shown in FIG. 8. Removal of the force applied to the pole allows the firing pin spring support 20 to retract and as the forward end 20*a* of the firing pin spring support retracts over the locking recess 12*a* in the firing pin 12 its rear edge engages the ramped forward surface 26*c* of the locking end portion 26*b* of the lock lever 26 and causes it to return to its radially outer position and also the firing pin returns to its original position (this is the configuration shown in FIG. 6).

Figure 9:
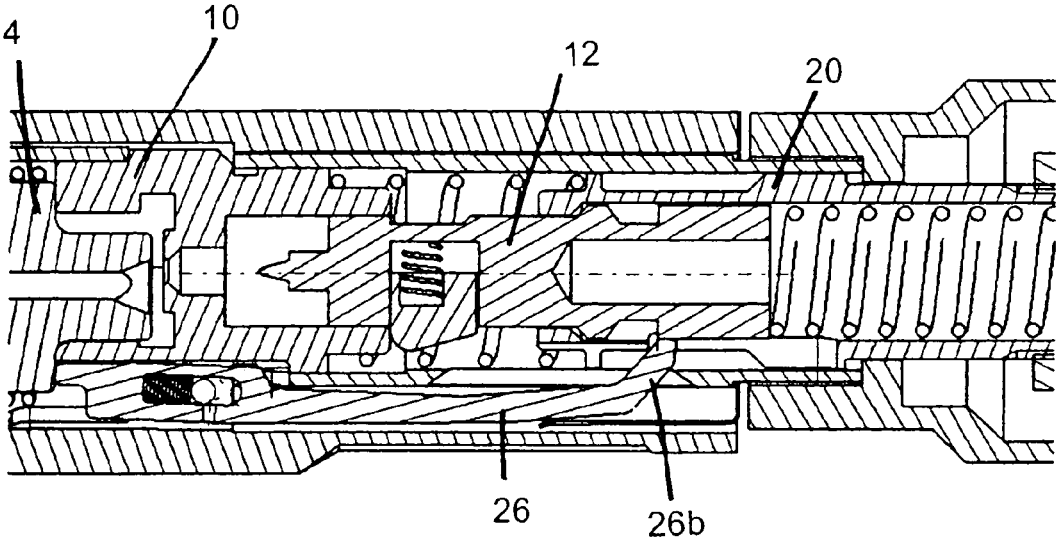
FIG. 9 shows the tool during loading of the firing mechanism shortly before firing during correct operation of the tool.
Figure 9A:
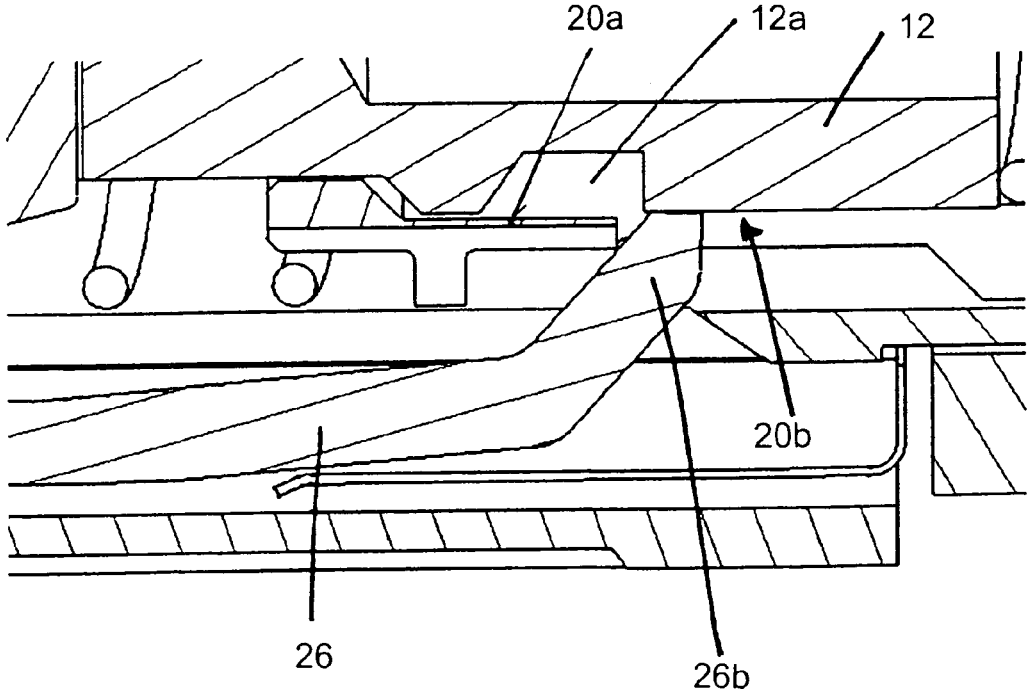
FIG. 9A shows an enlarged detail of FIG. 9.
Figure 10:
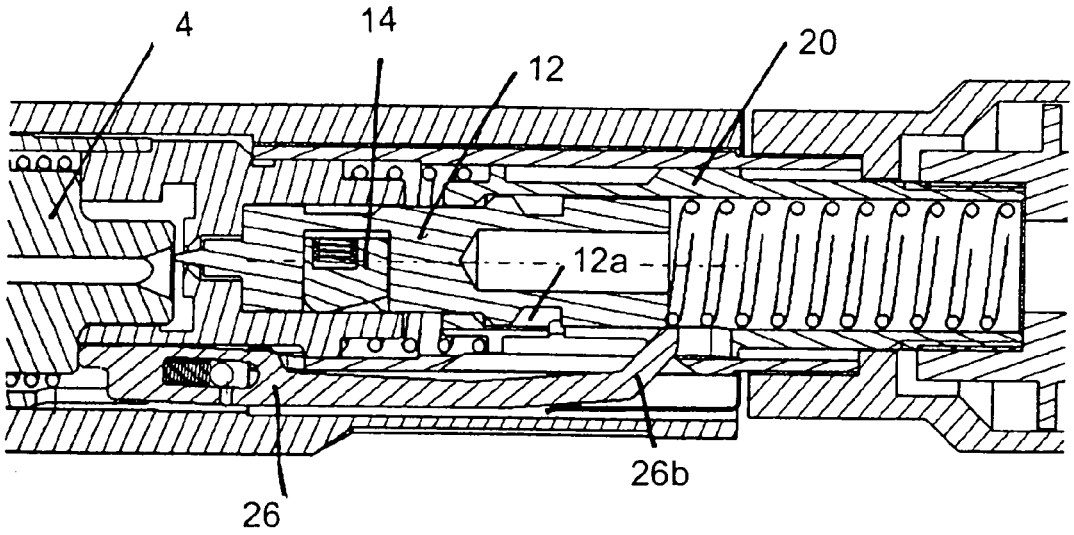
FIG. 10 shows the condition of the tool when firing has occurred.

Under correct operation of the tool when the forward end of the barrel 4 is pressed against the substrate, as the barrel 4 approaches its rearmost position its rear end will engage the forward end of the lock lever 26 and displace the lever rearwardly so that its locking end 26*b* displaces rearwardly into the slot 20*b* in the firing pin spring support 20 behind the locking recess 12*a* to engage the outer surface of the firing pin 12. This is shown in FIGS. 9 and 9A. The firing pin 12 is thus able to be released when the firing pin spring support 20 has advanced sufficiently to release the firing pin by engagement of its forward end of the pawl 14. FIG. 10 illustrates the configuration after release of the firing pin.

It is to be noted that when the locking end 26*b* of the lock lever 26 has engaged into the locking recess 12*a* consequent on an attempt to "air fire" the tool, subsequent displacement of the barrel into the housing will not then enable firing. Firing can only be enabled by the correct sequence of operation described in the preceding paragraph.

In the form of embodiment as shown the locking end of the lock lever is in alignment with the locking recess in the firing pin in the at rest position but the recess is closed by the presence of the forward end portion of the firing pin spring support and against which the locking end rests. In a modified form of this embodiment, the locking end of the lock lever may actually engage within the locking recess in the at rest position and upon correct actuation of the tool the rearwards displacement of the lock lever which occurs upon the rearwards displacement of the barrel also causes the locking end of the lever to be moved out of the locking recess; this movement can be induced by a camming action. The firing pin is thereby in a condition to be released to fire the charge when the firing pin spring support has moved forward sufficiently to cause release of the firing pin pawl.

The configurations of the lock lever particularly described are particularly advantageous as they are able to be incorporated within existing designs of pole tool without extensive modification.

The embodiments have been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. An explosively actuated tool for driving a fastener into a substrate, the tool being of the type mountable to an end of a handle to permit manipulation and actuation of the tool from a remote position wherein actuation of the tool occurs by pushing a forward end of a barrel of the tool against the substrate using the handle and then pushing on the handle which loads and then releases a firing mechanism of the tool, the firing mechanism including a firing pin, a firing pin spring, and a firing pin spring support by which the firing pin spring is loaded;

wherein the tool further comprises, in addition to said barrel and said firing mechanism, a lock device to prevent air firing of the tool by pushing the handle without the forward end of the barrel being pressed against the substrate, the lock device including a lock member which is engageable with one of the firing pin and the firing pin spring support to lock said one of the firing pin and the firing pin spring support against forward displacement unless the lock member is released by a prior axially rearward displacement of the barrel to a predetermined rearward position when the forward end thereof is pressed against the substrate; and wherein said lock member comprises a lever being both (i) displaceable axially of and relative to said barrel, and (ii) pivotable towards said one of the firing pin and the firing pin spring support.

2. The tool according to claim 1, wherein, when said lever has engaged with said one of the firing pin and the firing pin spring support, a subsequent rearward displacement of said barrel into the predetermined rearward position will not disengage said lever from said one of the firing pin and the firing pin spring support.

3. An explosively actuated tool for driving a fastener into a substrate, said tool comprising:

a housing;

a handle at a rear end of the housing;

a barrel from which the fastener is to be fired, the barrel being mounted within the housing to project from a forward end of the housing and the barrel being displaceable axially rearwardly relative to the housing;

a firing mechanism actuable by forward displacement of the handle; and a lock device for preventing actuation of the firing mechanism when the barrel is not in a predetermined rearward position within the housing;

wherein said lock device comprises a lever being both (i) displaceable axially relative to both said barrel and said housing, and (ii) pivotable towards said firing mechanism.

4. The tool according to claim 3, wherein the firing mechanism includes a structure driven by said handle and moveable forwardly relative to the housing to a firing position, a firing pin, and a firing pin spring which is positioned between the structure and the firing pin and is loaded by forward movement of the structure relative to the housing toward the firing position, wherein the structure being in the firing position causes said firing pin to be displaced forwardly under a spring force of the loaded firing pin spring, thereby effecting firing of said firing mechanism.

5. The tool according to claim 4, wherein the lever is biased to pivot towards said firing mechanism to a locking position in which a rear end portion of the lever projects into a path of the structure toward the firing position and prevents forward movement of said structure sufficient to effect firing, the lever being released from said locking position to a released position in response to displacement of the barrel rearwardly into said predetermined rearward position.

6. The tool according to claim 5, wherein release of the lever is effected by engagement of the lever with a rear end of the barrel as the barrel moves into the predetermined rearward position.

7. The tool according to claim 6, wherein the lever is displaced to the released position by a cam action when the rear end of the barrel engages a front end portion of the lever as the barrel moves into the predetermined rearward position.

8. The tool according to claim 7, further comprising a first cam surface on the lever and a second cam surface fixed to the housing, the cam action being provided by the first cam surface co-operating with the second cam surface, the lever being displaced axially rearwardly upon engagement by the rearwardly moving barrel whereby relative movement between the two co-operating cam surfaces causes the lever to pivot into the released position.

9. The tool according to claim 5, wherein said structure is a support which mounts the firing pin and the firing pin spring, the support having a coupling for releasable connection of the handle.

10. The tool according to claim 4, wherein the lever is biased to pivot towards said firing mechanism to a locking position in which said lever locks the firing pin against forward displacement in the event of forward movement of said structure absent displacement of the barrel into said predetermined rearward position.

11. The tool according to claim 4, wherein the lever is biased to pivot towards said firing mechanism to a locking position in which a rear end portion of the lever is in alignment with, or is within, a locking recess in the firing pin; and the lever is displaced out of the alignment with the locking recess, or out of said locking recess, into a disabled position in which the locking effect of the lever is disabled in response to movement of the barrel into the predetermined rearward position.

12. The tool according to claim 4, wherein the firing pin has a locking recess in which a locking part of the lever is receivable to prevent forward displacement of said firing pin and, hence, firing of said firing mechanism;

said structure is a firing pin spring support, which closes the locking recess and prevents the locking part of the lever from entering said locking recess when said firing pin spring support is in a rear position;

said firing pin spring support exposes the locking recess to permit entry of the locking part of the lever during forward displacement of said firing pin spring support toward the firing position, when the barrel is not in the predetermined rearward position.

13. The tool according to claim 12, wherein the locking part of the lever is axially rearwardly displaceable, by rearward displacement of the barrel into said predetermined rearward position, beyond a position in which the locking part can enter into the locking recess in the firing pin.

14. The tool according to claim 3, comprising a first spring urging said lever to pivot about a pivot pin towards said firing mechanism; and a second spring biasing said lever axially toward the forward end of said housing, said second spring being different from said first spring.

15. The tool according to claim 14, wherein said lever comprises an axial slot in which said pivot pin and said second spring are positioned, said second spring biasing said lever toward the forward end of said housing.

16. An explosively actuated tool for driving a fastener into a substrate, the tool being of the type mountable to an end of a handle to permit manipulation and actuation of the tool from a remote position wherein actuation of the tool occurs by pushing a forward end of a barrel of the tool against the substrate using the handle and then pushing on the handle which loads and then releases a firing mechanism of the tool, the firing mechanism including a firing pin, a firing pin spring, and a firing pin spring support by which the firing pin spring is loaded;

wherein the tool further comprises in addition to said barrel and said firing mechanism, a lock device to prevent air firing of the tool by pushing the handle without the forward end of the barrel being pressed against the substrate, the lock device including a lock member which cooperates with one of the firing pin and the firing pin spring support to lock said one of the firing pin and the firing pin spring support unless the lock member is released by a prior displacement caused by retraction of the barrel when the forward end thereof is pressed against the substrate; and wherein said lock member comprises a lever being both displaceable axially of said barrel and pivotable towards said one of the firing pin and the firing pin spring support;

said tool further comprising a first spring urging said lever to pivot towards said one of the firing pin and the firing pin spring support; and a second spring biasing said lever axially toward the forward end of said barrel, said second spring being different from said first spring.

17. The tool according to claim 16, wherein said lever comprises an axial slot, and a pivot pin about which said lever is pivotable wherein said pivot pin and said second spring are positioned in said axial slot, said second spring biasing said lever toward the forward end of said barrel.

* * * * *